US010384260B2

(12) United States Patent
Yang et al.

(10) Patent No.: US 10,384,260 B2
(45) Date of Patent: Aug. 20, 2019

(54) SERVO-ROTATING ALL-FUNCTION TOOL MODULE FOR USE WITH SPRING FORMING MACHINE

(71) Applicant: Union Precision Hardware Co., Ltd., Huizhou (CN)

(72) Inventors: Yao Ming Yang, New Taipei (TW); Hua Yun Hsin, Keelung (TW); Neng Wen Mao, Yuanjiang (CN)

(73) Assignee: UNION PRECISION HARDWARE CO., LTD., Huizhou, Guangdong Province (CN)

( * ) Notice: Subject to any disclaimer, the term of this patent is extended or adjusted under 35 U.S.C. 154(b) by 420 days.

(21) Appl. No.: 15/243,973

(22) Filed: Aug. 23, 2016

(65) Prior Publication Data

US 2017/0182545 A1 Jun. 29, 2017

(30) Foreign Application Priority Data

Dec. 24, 2015 (TW) ..... 104220665 U
May 10, 2016 (TW) ..... 105206687 U
Jun. 15, 2016 (TW) ..... 105208877 U

(51) Int. Cl.
*B21F 3/02* (2006.01)
*B21F 35/00* (2006.01)
*B21F 1/00* (2006.01)

(52) U.S. Cl.
CPC ..... *B21F 35/00* (2013.01); *B21F 1/006* (2013.01); *B21F 3/02* (2013.01)

(58) Field of Classification Search
CPC ... B21F 1/006; B21F 3/02; B21F 3/10; B21D 11/06
See application file for complete search history.

(56) References Cited

U.S. PATENT DOCUMENTS

2011/0016942 A1* 1/2011 Etienne ..... B21F 3/02 72/199
2015/0075244 A1* 3/2015 Itaya ..... B21F 3/02 72/135

* cited by examiner

*Primary Examiner* — Debra M Sullivan
(74) *Attorney, Agent, or Firm* — Chun-Ming Shih

(57) ABSTRACT

A servo-rotating all-function tool module is provided for use with a spring forming machine and includes an axle rotating tool module and a servo transmission module assembly. The axle rotating tool module is mounted to the axle and includes an axle slide base and a tool, so that the axle slide base is acted upon by a force to slide along the axle, the tool is caused to press downward or return upward. The servo transmission module assembly is mounted to the spring forming machine to provide a driving force for causing the axle slide base to slide along the axle. Since the tool module is mounted to an axle mounted to a front wall board of the spring forming machine, the direction in which the tool approaches a wire can be varied by rotating the axle in order to conduct operations of bending at different angles and twisting/looping.

13 Claims, 12 Drawing Sheets

SERVO-ROTATING ALL-FUNCTION TOOL MODULE FOR USE WITH SPRING FORMING MACHINE

(a) TECHNICAL FIELD OF THE INVENTION

The present invention relates generally to the field of spring forming machines, and more particularly to an all-function tool module that is drivable through rotation of a servo for being used with a spring forming machine.

(b) DESCRIPTION OF THE PRIOR ART

A spring forming machine is a piece of machinery for making various types or models of springs. The manufacturing process is generally such that a feeding roller that is capable of clamping and holding a wire for making a spring, which will be referred to as a spring-making wire for simplicity, is used to feed the spring-making wire through a through hole formed in a front wall board of the machine to allow various tools that are mounted to the front wall board to approach and engage, in a sideway direction, the spring-making wire to conduct various operations, such as bending, twisting or looping, and cutting, in order to complete the manufacture of a spring. In addition, various programs are loaded in advance in a processor combined with the spring forming machine so that execution of these programs controls the wire feeding means and the tools mounted to the front wall board of the spring forming machine to conduct various operations, such as bending, twisting or looping, and cutting, which are necessary for different phases of the manufacturing operation to thereby achieve the purposes of making springs of various types and models.

The above-discussed existing spring forming machine is fully capable of achieving the purpose of making various sorts of springs. However, the number of the tools that are mounted to the front wall board is limited and the tools are allowed to do linear movements on the front wall board so that the movements of the tools approaching the spring-making wire are generally of the same angle and direction, making it not possible to suit the needs for bending and twisting or looping in all directions during the manufacturing of springs manufacturing. To cope with such a problem, spring forming machines that are capable of rotating the wires are available. Such a kind of spring forming machines, however, is expensive and may be incapable of performing desired operations due to the gauges of the sprig-making wires being small, so that such machines do not suit the need for contemporary need for making diverse forms of springs.

SUMMARY OF THE INVENTION

In view of the above problems, the present invention provides a servo-rotating all-function tool module for use with a spring forming machine, which comprises tools mounted to a central axle mountable in a front wall board of the spring forming machine such that the central axle is rotatable to change the direction that a tool takes to approach a wire thereby achieving a function that is generally achievable with a high-end spring forming machine featuring all-direction bending.

To achieve the above and other objects, the present invention provides a servo-rotating all-function tool module, which is mountable to a spring forming machine to serve as an all-direction forming tool of the spring forming machine. The spring forming machine comprises a front wall board, an axle retention seat rotatably mounted to the front wall board, and an axle mounted to the axle retention seat. The tool module comprises an axle rotating tool module and a servo transmission module assembly.

In the tool module, the axle rotating tool module is mounted to the axle and comprises an axle slide base and a tool, such that the axle slide base is operable to slide along the axle upon receiving a driving force acting thereon so as to cause the tool to undergo a downward pressing or upward returning operation. The servo transmission module assembly is mounted to the spring forming machine to provide the driving force for driving the axle slide base to slide along the axle.

In an embodiment, the axle retention seat of the spring forming machine comprises an inner cam track and the axle rotating tool module of the servo-rotating all-function tool module comprises an axle slide base, an oscillating bar, a CF-series bearing, and the tool.

In the above module, the axle slide base comprises a slide base hole corresponding to the axle and an opening so as to be fit over the axle with the slide base hole for sliding along the axle. The oscillating bar comprises a first end and a second end, and a shaft hole formed therein at a location between the first end and the second end so as to mount, in a rotatable manner, the oscillating bar in the opening of the axle slide base.

The CF-series bearing is mounted to the first end of the oscillating bar and is set in contact engagement with the inner cam track of the axle retention seat in a manner of being allowed to roll along the inner cam track. The second end of the oscillating bar receives the tool to mount thereto. Thus, the servo transmission module assembly mounted to the spring forming machine drives the axle slide base to slide along the axle, the axle slide base causes the CF-series bearing to move along the inner cam track and thus ascend/descend to control the downward pressing or upward returning of the tool.

In an embodiment, the axle slide base of the servo-rotating all-function tool module mounted to the spring forming machine and the axle receive a self-lubricating bearing arranged therebetween to help the axle slide base to slide along the axle.

In an embodiment, the oscillating bar of the servo-rotating all-function tool module mounted to the spring forming machine is arranged such that a shaft pin that penetrates through the axle slide base receives a bearing fit thereto to rotatably support and mount the oscillating bar in the opening of the axle slide base in order to reduce friction coefficient of loading of the rotary shaft during a transmission process.

In an embodiment, the servo transmission module assembly of the servo-rotating all-function tool module mounted to the spring forming machine comprises: a support bracket, which is mounted to the front wall board at a location below the axle and comprises a slide track; a servomotor, which is mounted to the support bracket comprises a rotary shaft; a rotary disc, which is mounted to the rotary shaft and is driven by the rotary shaft to rotate; a link bar seat that comprises a central axle; a link bar; a slide block that is arranged on the slide track; and two CF-series bearings. The rotary disc comprises an eccentric shaft hole formed therein for mounting the link bar seat on the eccentric shaft hole. An end of the link bar is rotatably mounted to the central axle of the link bar seat and an opposite end of the link bar is rotatably mounted to the slide block, so that the two CF-series bearings, which are mounted to the slide block and clamp the axle slide base therebetween, drive the axle slide base to slide along the axle when the servomotor rotates.

In an embodiment, the servo transmission module assembly of the servo-rotating all-function tool module mounted to the spring forming machine further comprises a bearing arranged between the rotary shaft of the servomotor and the support bracket for supporting the rotary shaft so as to eliminate potential swaying incurring in the rotation of the servomotor.

In an embodiment, the servo transmission module assembly of the servo-rotating all-function tool module mounted to the spring forming machine further comprises a bearing arranged between the central axle of the link bar seat and the link bar to facilitate driving of the link bar.

In an embodiment, the servo transmission module assembly of the servo-rotating all-function tool module mounted to the spring forming machine comprises: a support bracket, which is mounted to a rear side of the front wall board; a servomotor, which is mounted to the support bracket and comprises a rotary shaft; a rotary disc, which is mounted to the rotary shaft and is driven by the rotary shaft to rotate; a cam seat, which comprises a guide rail; a bearing seat, which comprises a central axle extending into the guide rail; a bearing; two linear bearings, which are mounted to the front wall board; two slidable core shafts, which extend through the two linear bearings respectively and have an end mounted to the cam seat at two ends of the guide rail; a push bar, which is mounted to an opposite end of the two slidable core shafts; a push bar seat, which is mounted to the push bar; and two CF-series bearings.

In the above module, the rotary disc comprises an eccentric shaft hole formed therein for mounting the bearing seat on the eccentric shaft hole. The bearing is arranged between the guide rail and the central axle for driving the cam seat, the two slidable core shafts, the push bar, and the push bar seat to slide so as to causes the two CF-series bearings that are mounted to the push bar seat and clamp the axle slide base therebetween to drive the axle slide base to slide along the axle when the servomotor rotates.

In an embodiment, the servo transmission module assembly of the servo-rotating all-function tool module mounted to the spring forming machine further comprises a bearing arranged between the rotary shaft of the servomotor and the support bracket for supporting the rotary shaft so as to eliminate potential swaying incurring in the rotation of the servomotor.

In an embodiment, the axle rotating tool module of the servo-rotating all-function tool module mounted to the spring forming machine comprises a rotatable retention seat, an axle slide base, an oscillating bar, a CF-series bearing, a tool, and a spring.

In the above module, the rotatable retention seat comprises a seat body and a support arm comprising a slope extending forward from the seat body. The seat body is formed with a seat hole corresponding to the axle for fitting to and being fixed to the axle. The axle slide base comprises a slide base hole corresponding to the axle and an opening corresponding to the support arm so as to be fit to the axle with the slide base hole to slide along the axle. The oscillating bar comprises a first end and a second end, and a shaft hole formed therein at a location between the first end and the second end for rotatably mounting the oscillating bar in the opening of the axle slide base.

The CF-series bearing is mounted to the first end of the oscillating bar and is set in contact engagement with the seat body in a manner of being allowed to roll along the slope of the support arm and the tool is mounted to the second end of the oscillating bar. The spring is arranged between the second end of the oscillating bar and the axle slide base to provide an upward pulling force to the tool. The servo transmission module assembly is mounted to the front wall board to drive the axle slide base to slide along the axle for driving the CF-series bearing to move along the slope of the support arm to ascend/descend for controlling, in combination with the pulling force induced by the spring, a downward pressing operation or an upward returning operation of the tool.

In an embodiment, the axle slide base of the servo-rotating all-function tool module mounted to the spring forming machine and the axle receive a self-lubricating bearing arranged therebetween to help the axle slide base to slide along the axle.

In an embodiment, the oscillating bar of the servo-rotating all-function tool module mounted to the spring forming machine is arranged such that a shaft pin that penetrates through the axle slide base receives a bearing fit thereto to rotatably support and mount the oscillating bar in the opening of the axle slide base in order to reduce friction coefficient of loading of the rotary shaft during a transmission process.

In an embodiment, the servo-rotating all-function tool module mounted to the spring forming machine comprises a spring peg and a screw respectively mounted to the axle slide base and the second end of the oscillating bar to support and retain the spring between the second end of the oscillating bar and the axle slide base.

In summary, the present invention provides a servo-rotating all-function tool module for use with a spring forming machine and is applicable to all sorts of spring forming machines, wherein the direction in which a tool approaches a wire can be varied by rotating an axle in order to conduct operations such as bending at different angles and twisting/looping to achieve a function that is generally achievable with a high-end spring forming machine featuring all-direction bending.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
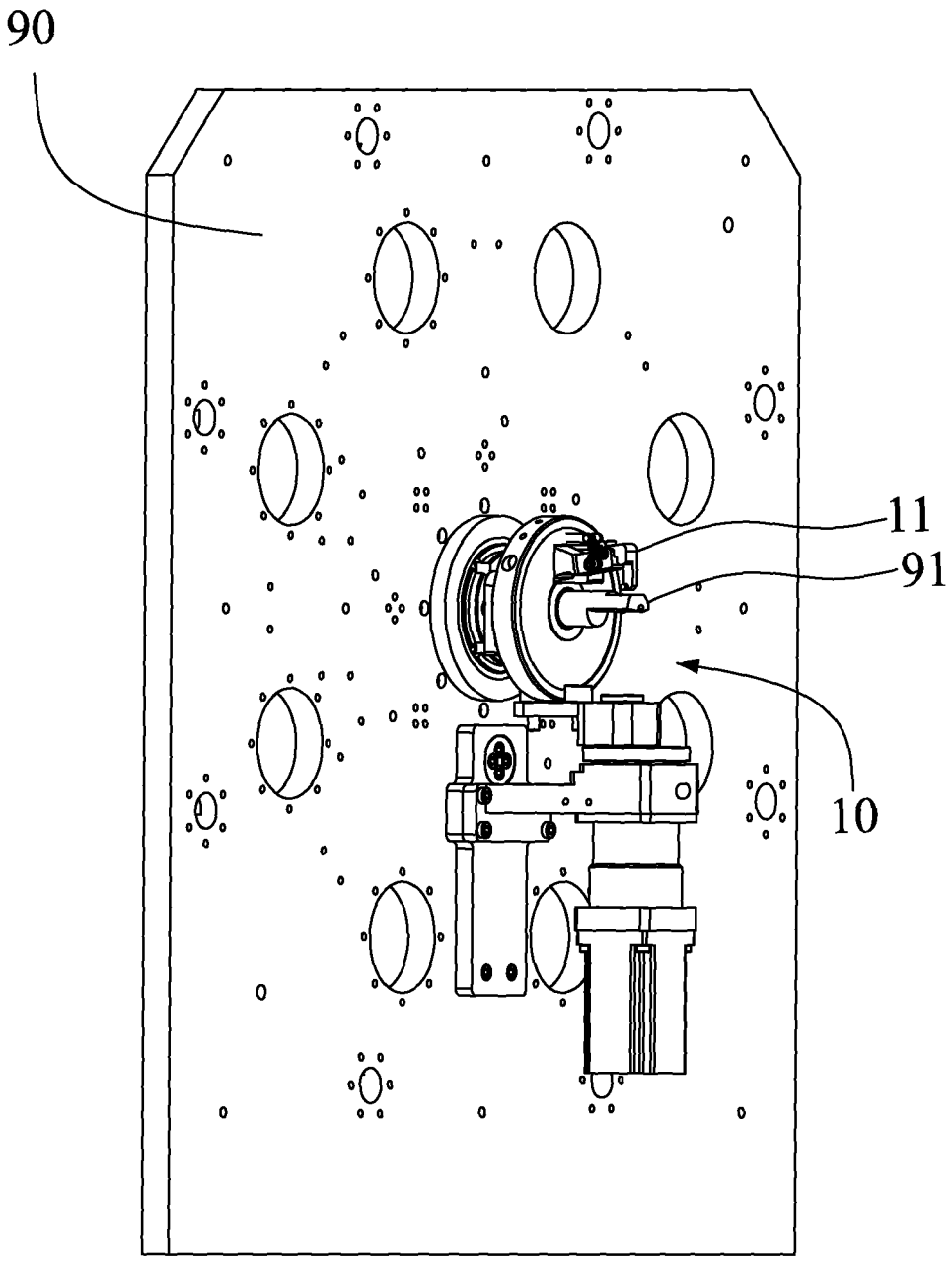
FIG. 1 is a perspective view showing a servo-rotating all-function tool module according to a first embodiment of the present invention mounted in a spring forming machine.
Figure 2:
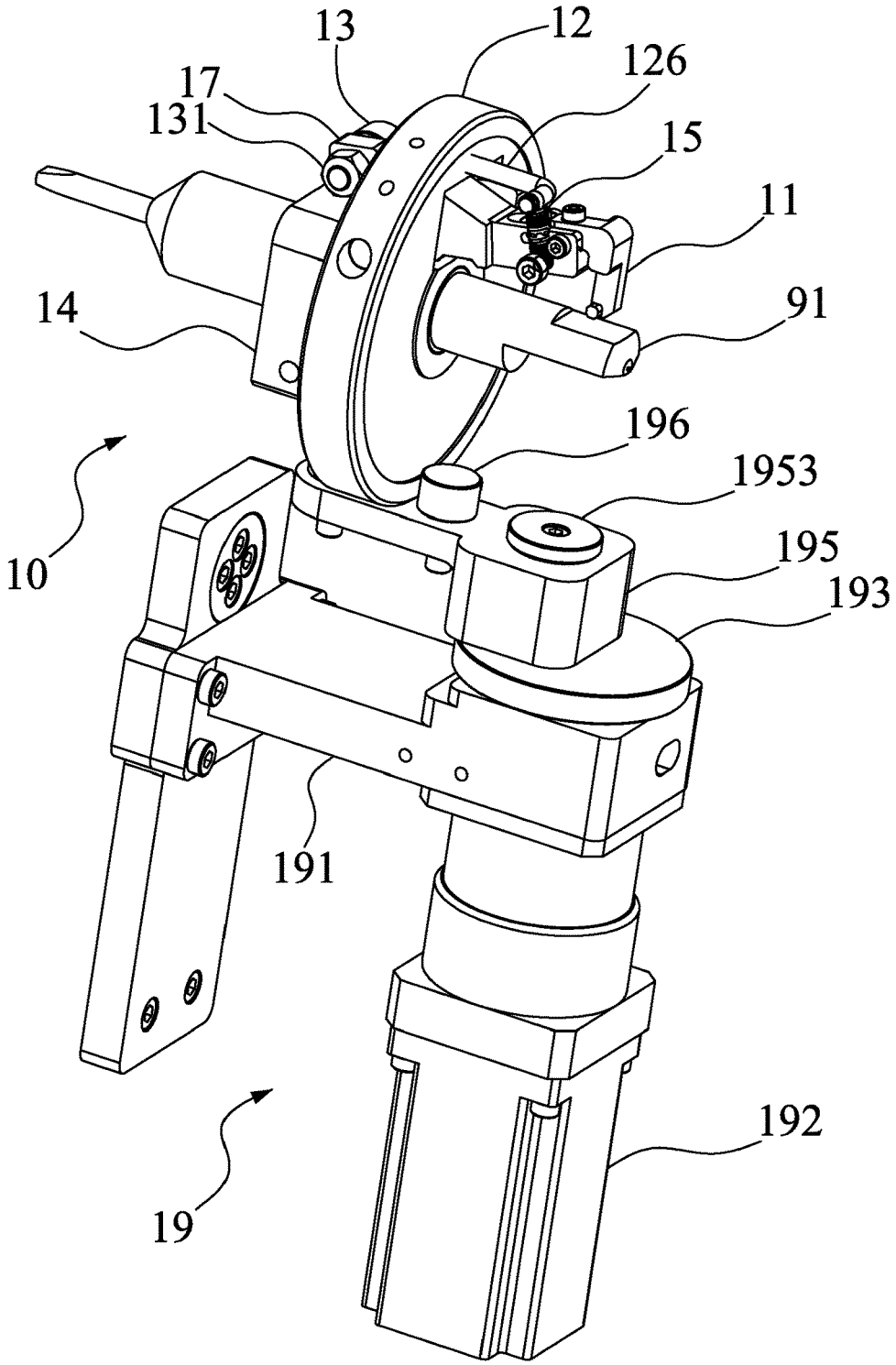
FIG. 2 is a perspective view illustrating a tool module and a front wall board axle of FIG. 1 in an assembled form.
Figure 3:
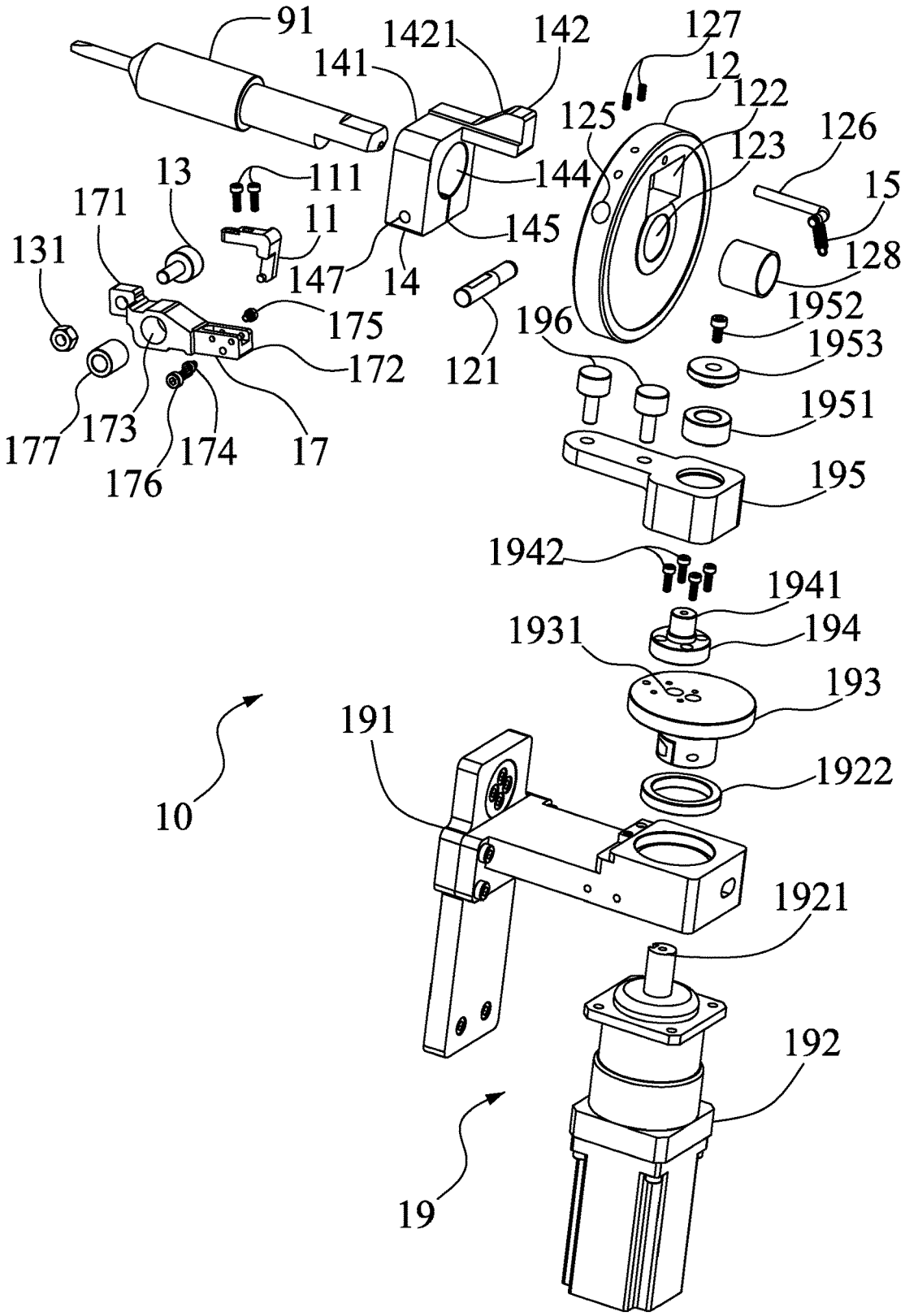
FIG. 3 is an exploded view of FIG. 2.
Figure 4:
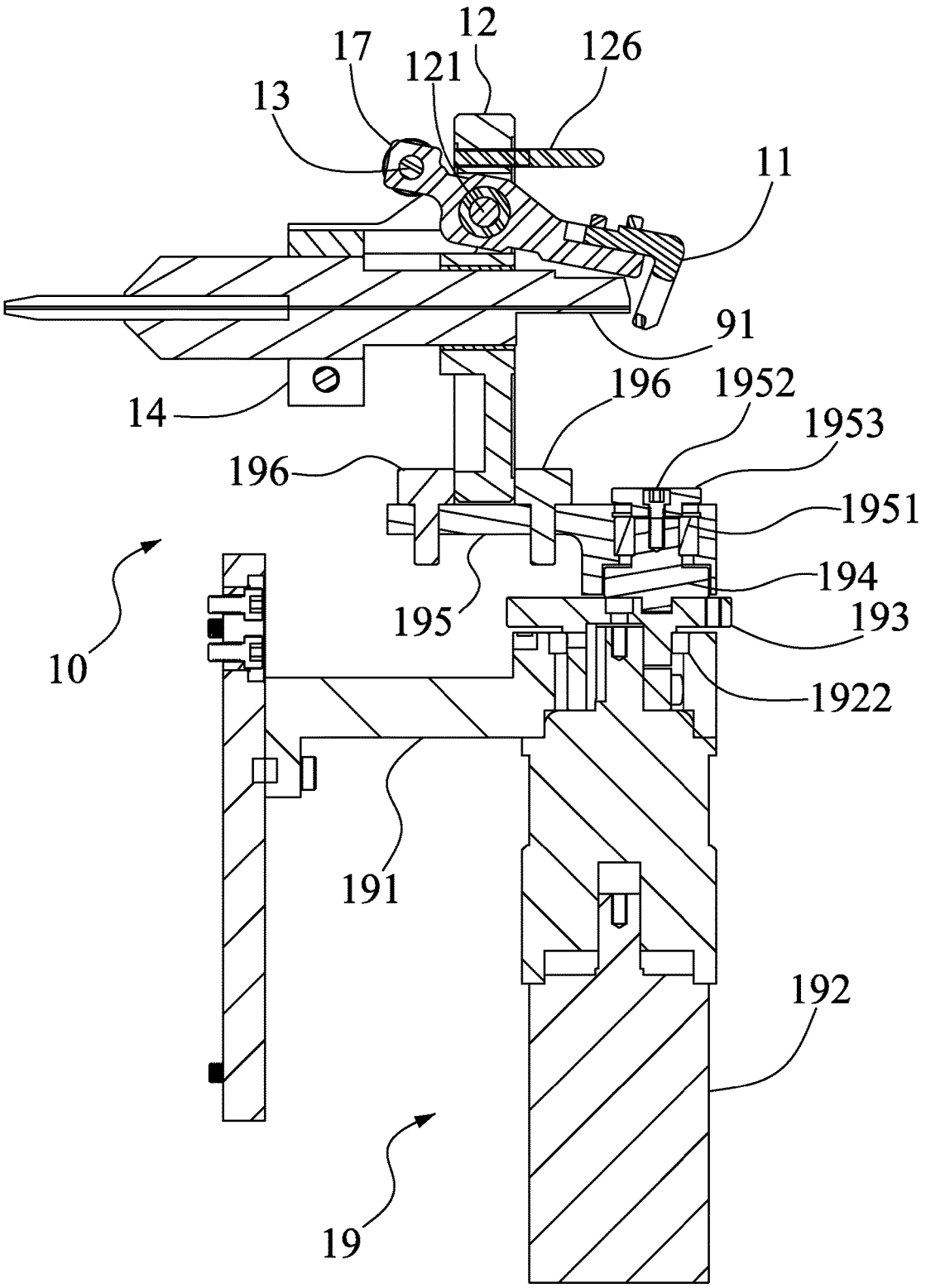
FIG. 4 is a cross-sectional view of FIG. 2.

Referring to FIG. 1, a schematic view is given to show a servo-rotating all-function tool module according to a first embodiment of the present invention mounted in a spring forming machine. As shown in the drawing, the tool module 10 comprises a tool 11 that is mounted on an axle 91 that is mounted to a front wall board 90 of the spring forming machine such that through rotation of the axle 91 mounted to the front wall board 90 of the spring forming machine, a direction in which a tool 11, such as a bending tool, of the tool module 10 is moved to approach a wire can be varied so as to achieve a function of all-direction bending of the wire without the need to rotate the wire whereby the tool is not subject to the same constraints of other tools (not shown) directly mounted to the front wall board 90 of the spring forming machine that are allow to conduct or perform a bending operation or other functions with a fixed angle due to installation angles thereof.

Referring to FIGS. 2-6, which are respectively a perspective view illustrating the tool module and the front wall board axle of FIG. 1 in an assembled form, an exploded view and a cross-sectional view thereof, and schematic views illustrating an operation of the tool of the tool module, as shown in the drawings, the tool module 10 comprises an axle rotating tool module that comprises a rotatable retention seat 14, an oscillating bar 17, a CF-series bearing 13, the tool 11, a spring 15, and an axle slide base 12 and a servo transmission module assembly 19.

In the drawing, the rotatable retention seat 14 comprises a seat body 141 and a support arm 142 comprising a slope 1421 extending forward from the seat body 141. The seat body 141 is formed with a seat hole 144 corresponding to the axle 91 of the front wall board 90. The seat hole 144 comprises a slit 145 extending downward therefrom to allow the rotatable retention seat 14 to be easily fit over the axle 91 and be fixed to a predetermined location on the axle 91 by having a screw (not shown) screwed into a threaded hole 147.

The axle slide base 12 comprises a slide base hole 123 corresponding to the axle 91 and an opening 122 corresponding to the support arm 142 and the oscillating bar 17 and is fit over the axle 91 by means of a self-lubricating bearing 128 arranged in the slide base hole 123 to be slidable along the axle 91. The oscillating bar 17 comprises a first end 171 and a second end 172 on which a tool seat is formed. Formed between the first end 171 and the second end 172 is a shaft hole 173, which is fit over a shaft pin 121, which is fit into a through hole 125 of the axle slide base 12 and is fixed to the axle slide base 12 by screws 127, by means of a bearing 177 arranged in the shaft hole 173 so as to mount the oscillating bar 17 in the opening 122 of the axle slide base 12 in a rotatable manner.

The CF-series bearing 13 is fixed by a nut 131 to the first end 171 of the oscillating bar 17 and is set in contact engagement with the seat body 141 of the rotatable retention seat 14 in a manner of being allowed to roll along the slope 1421 of the support arm 142. The tool seat of the second end 172 of the oscillating bar 17 is provided with and coupled to the tool 11, which can be one of for example a bending tool, a twisting/looping tool, and a cutting tool for conducting a spring forming operation, by means of screws 111, wherein before the screws 111 that fix the tool 11 are tightened, regulation screws 174, 175 provided on two opposite sides of the second end 172 of the oscillating bar 17 can be used to adjust a mounting angle of the tool 11.

In addition, the second end 172 of the oscillating bar 17 is provided with a screw 176 screwed thereto and the axle slide base 12 is provided with a spring peg 126 securely mounted there to so that two ends of the spring 15 are respectively attached and fixed to the screw 176 and the spring peg 126 to provide a pulling force that biases the tool that is mounted to the tool seat of the second end 172 of the oscillating bar 17. The servo transmission module assembly 19, which is mounted to the front wall board 90, may drive the axle slide base 12 to slide along the axle 91, causing the CF-series bearing 13 to move along the slope 1421 of the support arm 142 for ascending and descending, so that this, in combination with the pulling force of the spring 15, controls a downward pressing operation and/or an upward returning operation of the tool 11 mounted to the tool seat of the second end 172 of the oscillating bar 17.

The servo transmission module assembly 19 comprises a support bracket 191 that is mounted to the front wall board 90 at a location below the axle 91, a servomotor 192, which is mounted to the support bracket 191 and comprises a rotary shaft 1921 and of which an example may comprise a speed reducer, a rotary disc 193 that is mounted to the rotary shaft 1921 and is driven by the rotary shaft 1921 to rotate, a link bar seat 194 that comprises a central axle 1941, a link bar 195, and two CF-series bearings 196.

The rotary disc 193 comprises an eccentric shaft hole 1931 mounted thereto. The link bar seat 194 is fixed by screws 1942 on the eccentric shaft hole 1931, and the link bar 195 is rotatably mounted to the central axle 1941 of the link bar seat 194 by means of a bearing 1951, a screw 1952, and a pad 1953. The CF-series bearings 196 that are mounted to the link bar 195 clamp, from opposite sides, the axle slide base 12 (see FIGS. 2 and 4) therebetween, so that when the servomotor 192 rotates, the axle slide base 12 is driven to slide along the axle 91. To eliminate potential swaying caused by the rotation of the servomotor 192, a bearing 1922 is arranged between the rotary shaft 1921 of the servomotor 192 and the support bracket 191.

Figure 6:
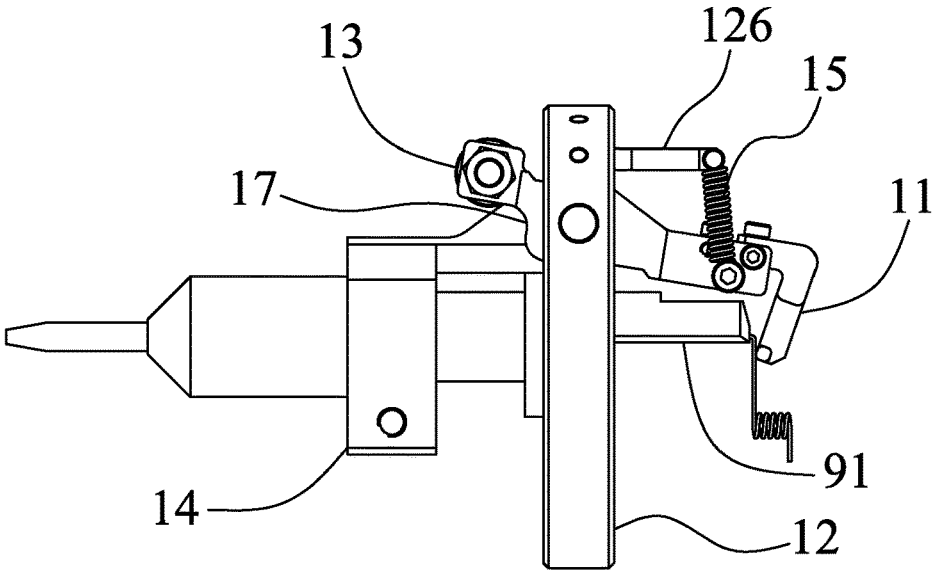
FIG. 6 is a schematic view illustrating a condition where the tools of the tool module shown in FIG. 2 are put into operation.

In the drawing, to operate the servo-rotating all-function tool module 10 that is provided for use with a spring forming machine, control is first made to the rotation of the axle 91 in order to rotate and set the tool 11 attached thereto to a desired direction for conducting a bending operation or other functions, and then, control is made to the rotation of the servomotor 192 that is mounted to the front wall board 90 of the spring forming machine in order to have the servomotor 192 cause the rotary disc 193 and the link bar seat 194 mounted on the eccentric shaft hole 1931 of the rotary disc 193 to rotate so that the link bar 195 that is rotatably mounted to the central axle 1941 of the link bar seat 194 converts the rotational movement into a linear movement to allow the CF-series beatings 196 that clamp the axle slide base 12 therebetween to force the axle slide base 12 to slide along the axle 91 and thus causing the CF-series bearing 13 to ascend by moving along the slope 1421 of the support arm 142, whereby the oscillating bar 17 is cause to oscillate and set the tool 11 of the tool module 10, which can be a bending tool, to press against the wire for conducting bending of the wire in a desired direction (see FIG. 6).

Figure 5:
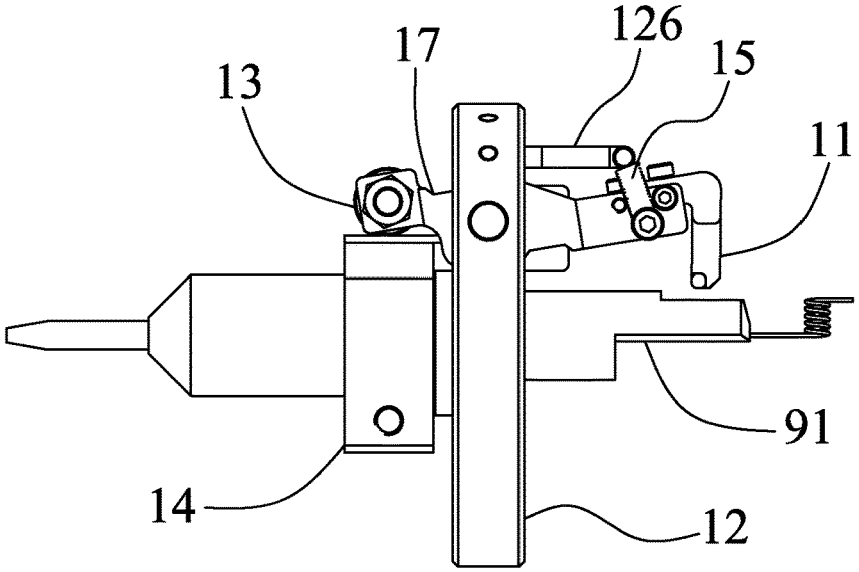
FIG. 5 is a schematic view illustrating a condition where tools of the tool module shown in FIG. 2 are not put into operation.

After the bending operation has been completed, control is made on the rotation of the servomotor 192 to allow the servomotor 192 to drive the rotary disc 193 and the link bar seat 194 that is mounted on the eccentric shaft hole 1931 of the rotary disc 193 to rotate and the link bar 195 that is rotatably mounted to the central axle 1941 of the link bar seat 194 to convert the rotational movement into a linear movement so that the CF-series bearings 196 that clamps the axle slide base 12 therebetween force the axle slide base 12 to slide along the axle 91, thus causing the CF-series bearing 13 to move along the slope 1421 of the support arm 142 to descend so that this, in combination with the pulling force of the spring 15 causes the oscillating bar 17 to move thereby controlling an upward returning operation of the tool 11 (see FIG. 5).

Figure 7:
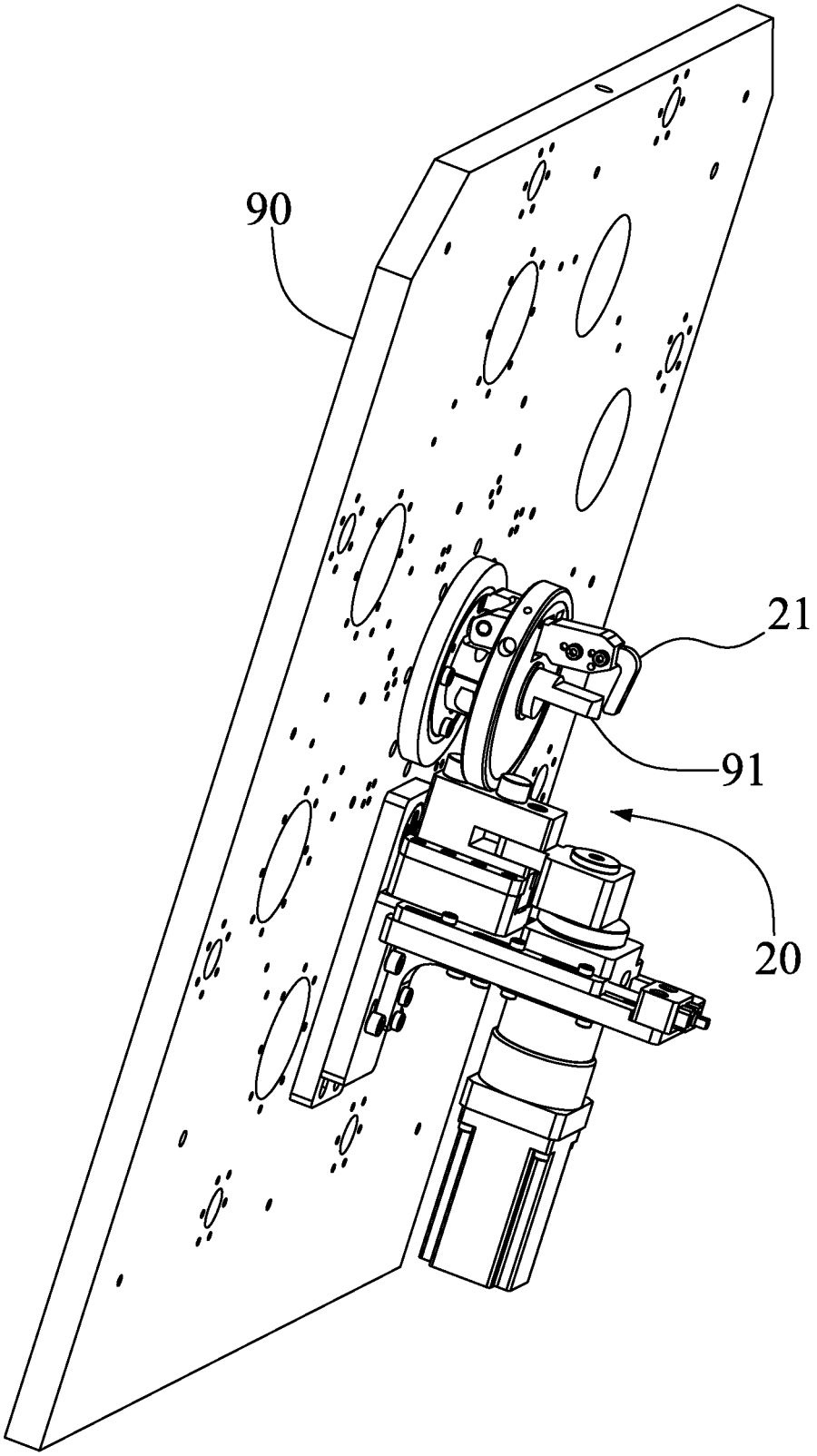
FIG. 7 is a perspective view showing a servo-rotating all-function tool module according to a second embodiment of the present invention mounted in a spring forming machine.
Figure 8:
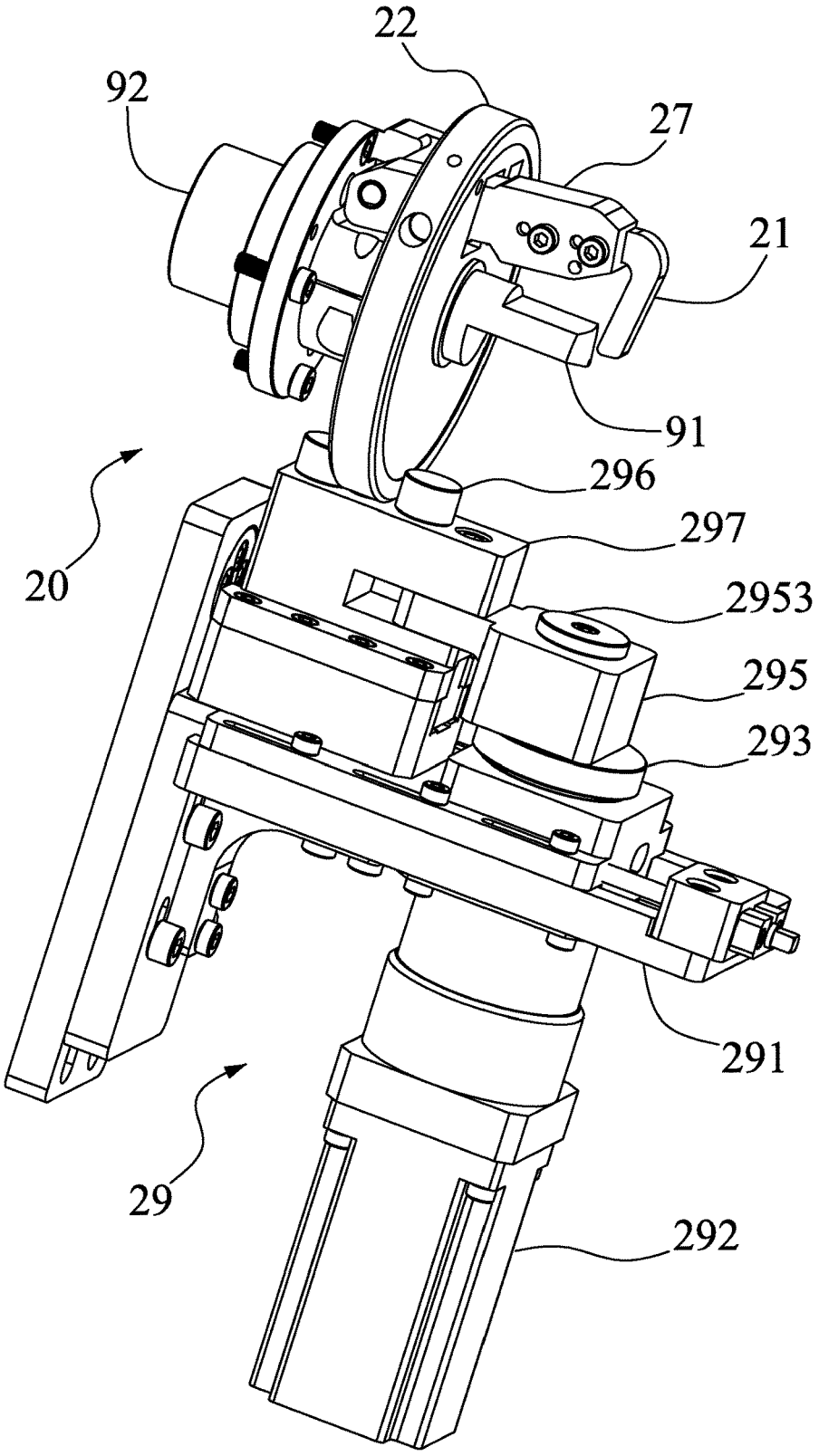
FIG. 8 is a perspective view illustrating a tool module, an axle retention seat of the front wall board, and an axle of FIG. 7 in an assembled form.
Figure 9:
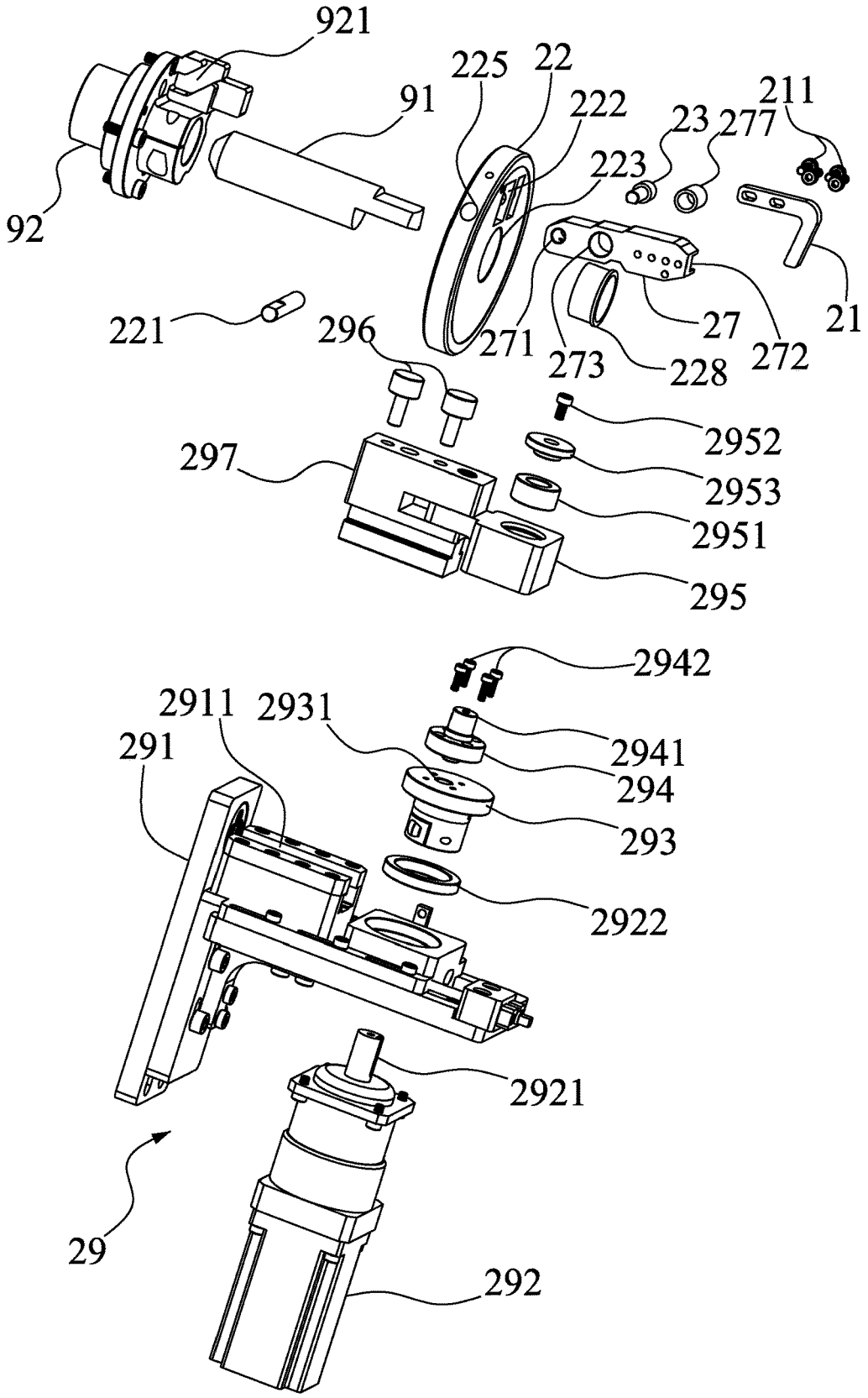
FIG. 9 is an exploded view of FIG. 8.

Referring to FIGS. 7-9, FIG. 7 is a perspective view showing a servo-rotating all-function tool module according to a second embodiment of the present invention mounted in a spring forming machine; FIG. 8 is a perspective view illustrating a tool module, an axle retention seat of the front wall board, and an axle of FIG. 7 in an assembled form; and FIG. 9 is an exploded view of FIG. 8.

As shown in the drawings, the spring forming machine comprises an axle retention seat 92 rotatably mounted to the front wall board 90 and an axle 91 mounted to the axle retention seat 92. The axle retention seat 92 comprises an inner cam track 921 formed thereon and a tool module 20 comprises a tool 21 that is mounted to the axle 91 that is mounted to the front wall board 90 of the spring forming machine such that through rotation of the axle 91 mounted to the front wall board 90 of the spring forming machine, a direction in which a tool 21 of the tool module 20 is moved to approach a wire can be varied so as to achieve a function of all-direction bending of the wire without the need to rotate the wire.

In the drawing, the tool module 20 comprises an axle rotating tool module that comprises an oscillating bar 27, a CF-series bearing 23, the tool 21, and an axle slide base 22 and a servo transmission module assembly 29. The axle slide base 22 comprises a slide base hole 223 corresponding to the axle 91 and an opening 222 and is fit over the axle 91 by means of a self-lubricating bearing 228 arranged in the slide base hole 223 to be slidable along the axle 91. The oscillating bar 27 comprises a first end 271 and a second end 272 on which a tool seat is formed. Formed between the first end 271 and the second end 272 is a shaft hole 273, which is fit over a shaft pin 221, which is fit into a through hole 225 of the axle slide base 22 and is fixed to the axle slide base 22 by screws (not shown), by means of a bearing 277 arranged in the shaft hole 273 so as to mount the oscillating bar 27 in the opening 222 of the axle slide base 22 in a rotatable manner.

The CF-series bearing 23 is fixed to the first end 271 of the oscillating bar 27 and is set in contact engagement with the inner cam track 921 of the axle retention seat 92 in a manner of being allowed to roll along the inner cam track 921. The tool seat of the second end 272 of the oscillating bar 27 is provided with and coupled to the tool 21, which can be one of for example a bending tool, a twisting/looping tool, and a cutting tool for conducting a spring forming operation, by means of screws 211.

Figure 10:
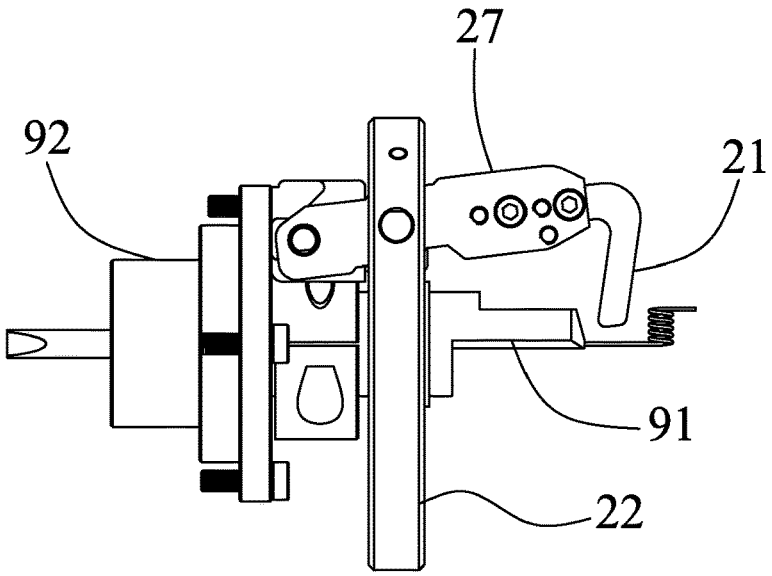
FIG. 10 is a schematic view illustrating a condition where tools of the tool module shown in FIG. 8 are not put into operation.
Figure 11:
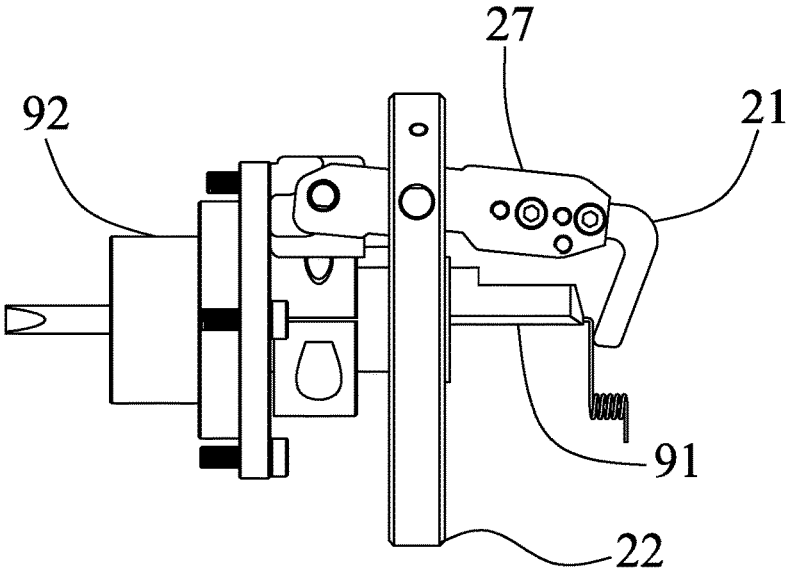
FIG. 11 is a schematic view illustrating a condition where the tools of the tool module shown in FIG. 8 are put into operation.

Thus, the servo transmission module assembly 29 that is mounted to the front wall board 90 is operable to drive the axle slide base 22 to slide along the axle 91 so as to drive the CF-series bearing 23 to roll and thus ascend/descend along the inner cam track 921 of the axle retention seat 92 for controlling a downward pressing operation of the tool 21 that is mounted to the tool seat of the second end 272 of the oscillating bar 27 (see FIG. 11) or an upward returning operation thereof (see FIG. 10).

The servo transmission module assembly 29 comprises a support bracket 291 that is mounted to the front wall board 90 at a location below the axle 91 and comprise a slide track 2911, a servomotor 292, which is mounted to the support bracket 291 and comprises a rotary shaft 2921 and of which an example may comprise a speed reducer, a rotary disc 293 that is mounted to the rotary shaft 2921 and is driven by the rotary shaft 2921 to rotate, a link bar seat 294 that comprises a central axle 2941, a link bar 295, a slide block 297 positioned on the slide track 2911, and two CF-series bearings 296.

The rotary disc 293 comprises an eccentric shaft hole 2931 mounted thereto. The link bar seat 294 is fixed by screws 2942 on the eccentric shaft hole 2931, and an end of the link bar 295 is rotatably mounted to the central axle 2941 of the link bar seat 294 by means of a bearing 2951, a screw 2952, and a pad 2953, while an opposite end of the link bar 295 is rotatably mounted to the slide block 297. The CF-series bearings 296 that are mounted to the slide block 297 clamp, from opposite sides, the axle slide base 22 (see FIG. 8) therebetween, so that when the servomotor 292 rotates, the axle slide base 22 is driven to slide along the axle 91. To eliminate potential swaying caused by the rotation of the servomotor 292, a bearing 2922 is arranged between the rotary shaft 2921 of the servomotor 292 and the support bracket 291.

Figure 12:
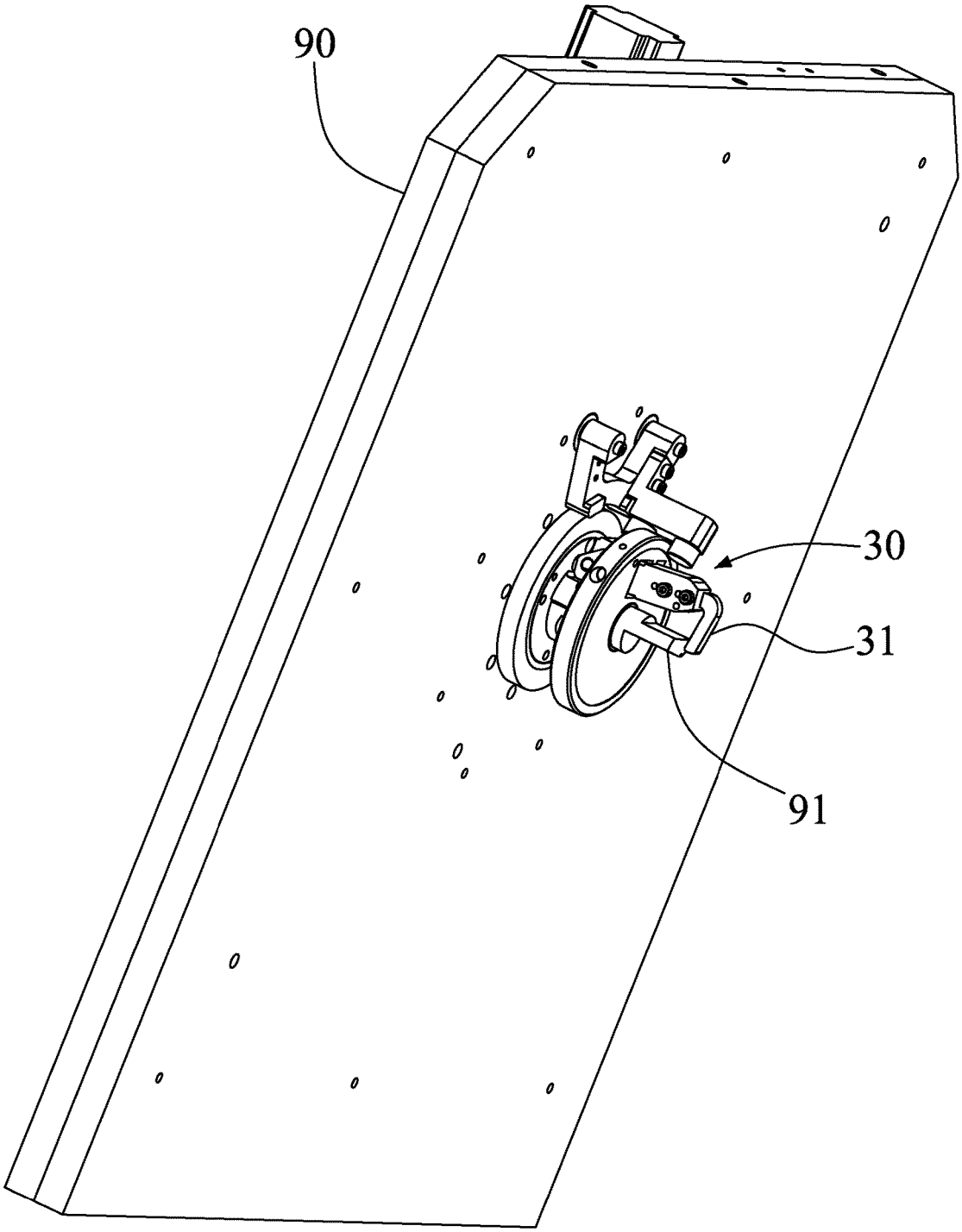
FIG. 12 is a perspective view showing a servo-rotating all-function tool module according to a third embodiment of the present invention mounted in a spring forming machine.
Figure 13:
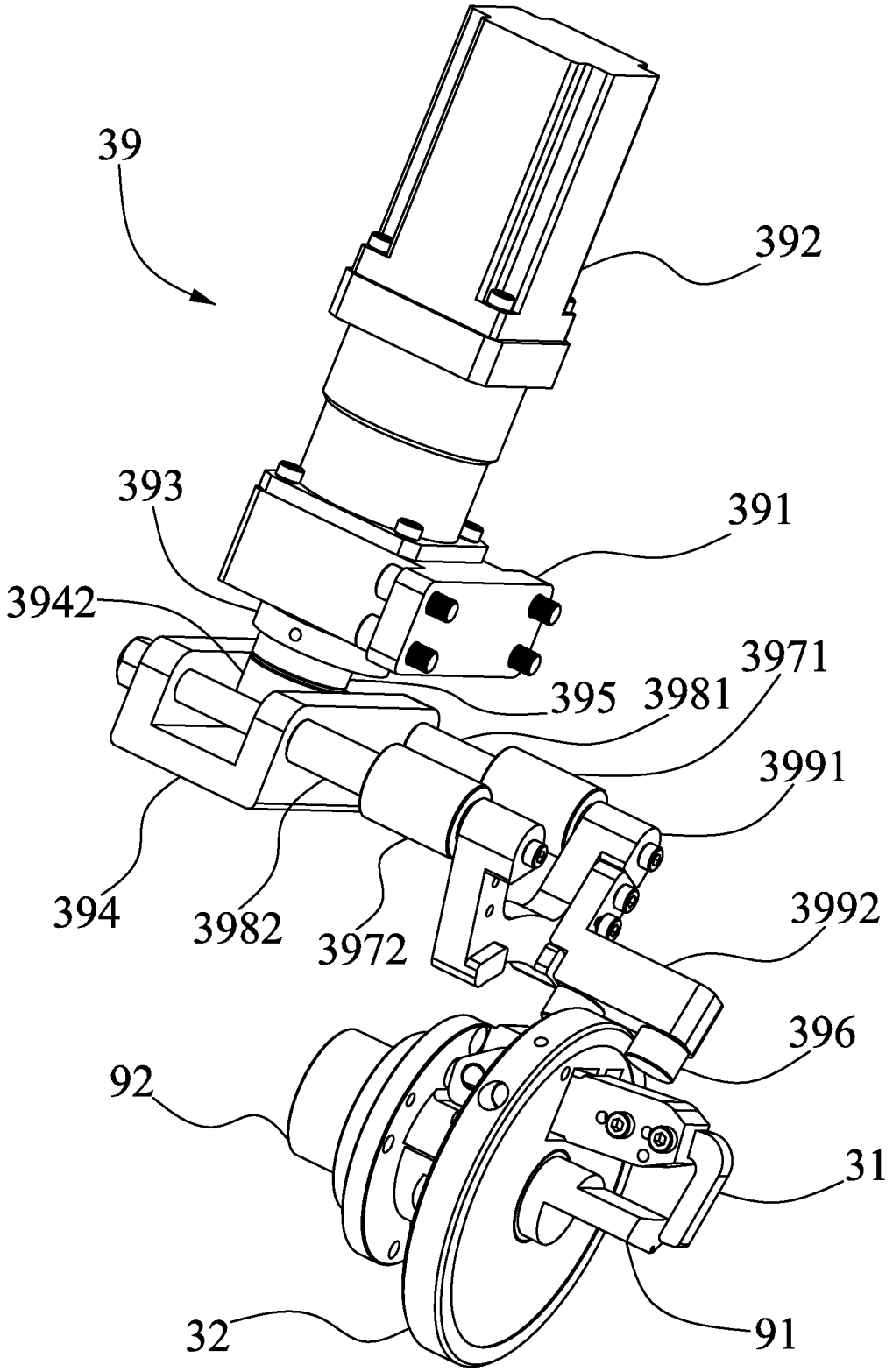
FIG. 13 is a perspective view illustrating a tool module, an axle retention seat of the front wall board, and an axle of FIG. 10 in an assembled form.
Figure 14:
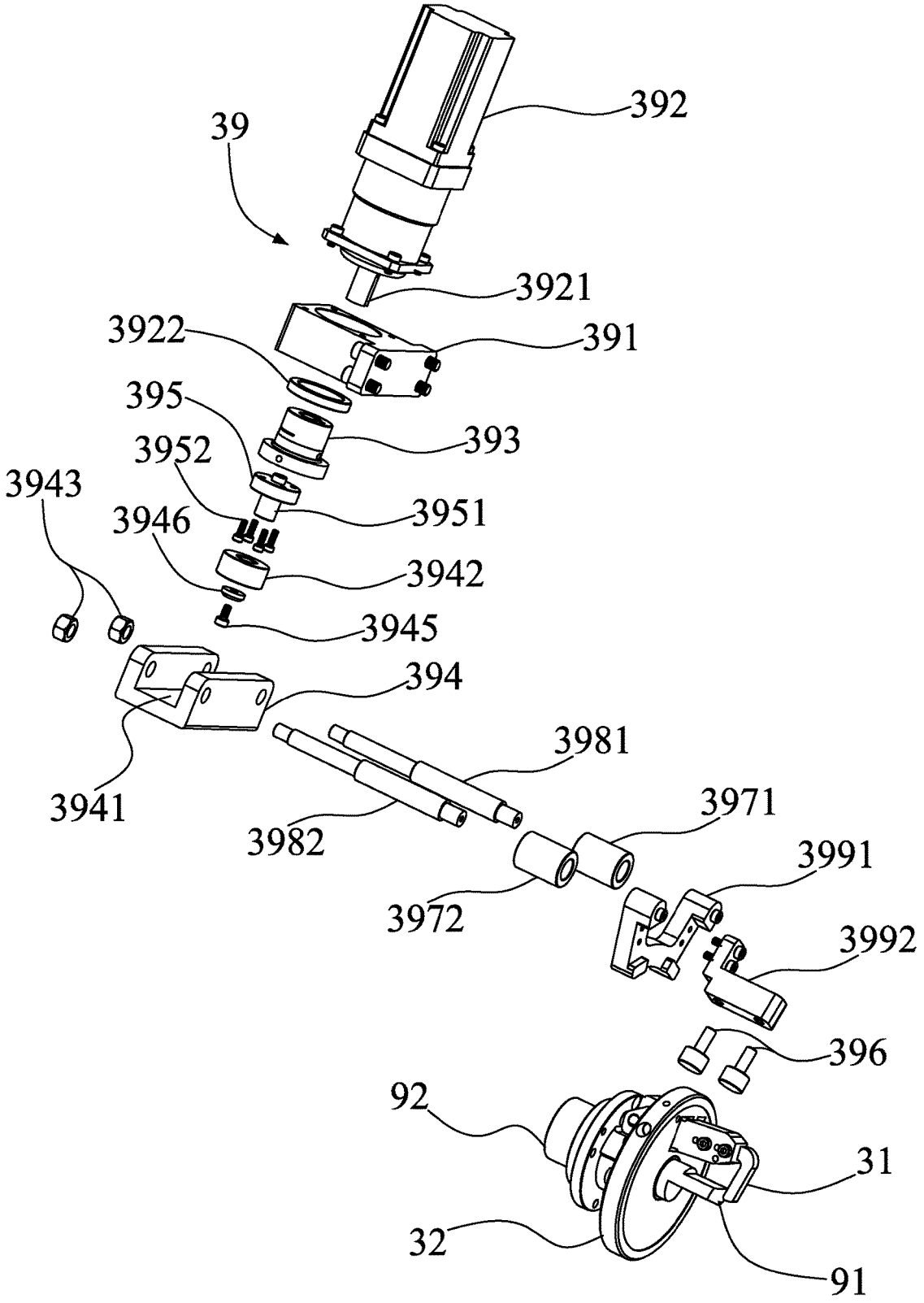
FIG. 14 is an exploded view of FIG. 11.

Referring to FIGS. 12-14, FIG. 12 is a perspective view showing a servo-rotating all-function tool module according to a third embodiment of the present invention mounted in a spring forming machine; FIG. 13 is a perspective view illustrating a tool module, an axle retention seat of the front wall board, and an axle of FIG. 12 in an assembled form; and FIG. 14 is an exploded view of FIG. 12.

As shown in the drawings, the spring forming machine comprises an axle retention seat 92 rotatably mounted to the front wall board 90 and an axle 91 mounted to the axle retention seat 92. The axle retention seat 92 comprises an inner cam track 921 formed thereon and a tool module 30 comprises a tool 31 that is mounted to the axle 91 that is mounted to the front wall board 90 of the spring forming machine such that through rotation of the axle 91 mounted to the front wall board 90 of the spring forming machine, a direction in which a tool 31 of the tool module 30 is moved to approach a wire can be varied so as to achieve a function of all-direction bending of the wire without the need to rotate the wire.

In the drawing, the tool module 30 comprises an axle rotating tool module and a servo transmission module assembly 39. In the instant embodiment, the axle rotating tool module has a structure similar to that of the second embodiment so that repeated description will be omitted. In the following, a description is only given to the structure of the servo transmission module assembly 39.

The servo transmission module assembly 39 comprises a support bracket 391 that is mounted to a rear side of the front wall board 90, a servomotor 392, which is mounted to the support bracket 391 and comprises a rotary shaft 3921 and of which an example may comprise a speed reducer, a rotary disc 393 that is mounted to the rotary shaft 3921 and is driven by the rotary shaft 3921 to rotate, a cam seat 394 that comprises a guide rail 3941, a bearing seat 395 that comprises a central axle 3951 extending into the guide rail 3941, a bearing 3942, two linear bearings 3971, 3972 that are mounted to the front wall board 90, two slidable core shafts 3981, 3982 that respectively extend through the two linear bearings 3971, 3972 and have an end mounted by nuts 3943 to the cam seat 394 at two ends of the guide rail 3941, a push bar 3991 mounted to an opposite end of the two slidable core shafts 3981, 3982, a push bar seat 3992 mounted to the push bar 3991, and two CF-series bearings 396.

The rotary disc 393 comprises an eccentric shaft hole (not shown), and the bearing seat 395 is mounted by screws 3952 on the eccentric shaft hole. The bearing 3942 is fixed by means of a screw 3945 and a pad 3946 to the central axle 3951 extending into the guide rail 3941 of the cam seat 394, so that the bearing 3942 arranged between the guide rail 3941 and the central axle 3951 may drive the cam seat 394, the two slidable core shafts 3981, 3982, the push bar 3991, and the push bar seat 3992 to slide thereby driving the two CF-series bearings 396 that are mounted to the push bar seat 3992 and clamp the axle slide base 32 therebetween (see FIG. 13) to drive the axle slide base 32 to slide along the axle 91 when the servomotor 392 rotates. To eliminate potential swaying caused by the rotation of the servomotor 392, a bearing 3922 is arranged between the rotary shaft 3921 of the servomotor 392 and the support bracket 391.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A servo-rotating all-function tool module, which is adapted to be mounted to a spring forming machine to serve as an all-direction forming tool of the spring forming machine, wherein the spring forming machine comprises a front wall board, a rotatable axle retention seat rotatably mounted to the front wall board, and an axle mounted to the axle retention seat, wherein the axle retention seat comprises a seat body and a support arm comprising a slope extending forward from the seat body, the seat body being formed with a seat hole corresponding to the axle for fitting to and being fixed to the axle, the tool module comprising:

an axle rotating tool module assembly, which is arranged to rotate with the axle and comprises an oscillating bar and a tool mounted on the oscillating bar, and the oscillating bar is operable to oscillate so as to cause the tool to undergo a downward pressing or upward returning operation; and a servo transmission module assembly, which is mounted to the spring forming machine to provide a driving force for driving the oscillation of the oscillating bar.

2. A servo-rotating all-function tool module, which is adapted to be mounted to a spring forming machine to serve as an all-direction forming tool of the spring forming machine, wherein the spring forming machine comprises a front wall board, a rotatable axle retention seat rotatably mounted to the front wall board, and an axle mounted to the axle retention seat, wherein the axle retention seat comprises an inner cam track, the tool module comprising:

an axle rotating tool module assembly, which is arranged to rotate with the axle and comprises an oscillating bar;

a tool mounted on the oscillating bar;

an axle slide base, which comprises a slide base hole corresponding to the axle and an opening so as to be fit over the axle with the slide base hole for sliding along the axle;

the oscillating bar is operable to oscillate so as to cause the tool to undergo a downward pressing or upward returning operation and further comprises a first end and a second end, and a shaft hole formed therein at a location between the first end and the second end so as to mount, in a rotatable manner, the oscillating bar in the opening of the axle slide base;

a CF-series bearing, which is mounted to the first end of the oscillating bar and is set in contact engagement with the inner cam track of the axle retention seat in a manner of being allowed to roll along the inner cam track; and the tool, which is mounted to the second end of the oscillating bar; and a servo transmission module assembly, which is mounted to the spring forming machine to provide a driving force for driving the oscillation of the oscillating bar, wherein when the servo transmission module assembly drives the axle slide base to slide along the axle, the axle slide base causes the CF-series bearing to move along the inner cam track and thus ascend/descend to control the downward pressing or upward returning of the tool.

3. The servo-rotating all-function tool module according to claim 2, wherein the axle slide base and the axle comprise a self-lubricating bearing arranged therebetween.

4. The servo-rotating all-function tool module according to claim 2, wherein a shaft pin that penetrates through the axle slide base receives a bearing fit thereto to rotatably support and mount the oscillating bar in the opening of the axle slide base.

5. The servo-rotating all-function tool module according to claim 2, wherein the servo transmission module assembly comprises:

a support bracket, which is mounted to the front wall board at a location below the axle and comprises a slide track;

a servomotor, which is mounted to the support bracket comprises a rotary shaft;

a rotary disc, which is mounted to the rotary shaft and is driven by the rotary shaft to rotate, the rotary disc comprising an eccentric shaft hole formed therein;

a link bar seat, which is mounted on the eccentric shaft hole comprises a central axle;

a link bar, which has an end rotatably mounted to the central axle;

a slide block, which is positioned on the slide track and is rotatably mounted to an opposite end of the link bar; and the two CF-series bearings, which are mounted to the slide block and clamp the axle slide base therebetween so as to drive the axle slide base to slide along the axle when the servomotor rotates.

6. The servo-rotating all-function tool module according to claim 5, wherein the rotary shaft and the support bracket comprise a bearing arranged therebetween.

7. The servo-rotating all-function tool module according to claim 5, wherein the central axle and the link bar comprise a bearing arranged therebetween.

8. The servo-rotating all-function tool module according to claim 2, wherein the servo transmission module assembly comprises:

a support bracket, which is mounted to a rear side of the front wall board;

a servomotor, which is mounted to the support bracket and comprises a rotary shaft;

a rotary disc, which is mounted to the rotary shaft and is driven by the rotary shaft to rotate, the rotary disc comprising an eccentric shaft hole formed therein;

a cam seat, which comprises a guide rail;

a bearing seat, which is mounted on the eccentric shaft hole comprises a central axle extending into the guide rail;

a bearing, which is arranged between the guide rail and the central axle;

two linear bearings, which are mounted to the front wall board;

two slidable core shafts, which extend through the two linear bearings respectively and have an end mounted to the cam seat at two ends of the guide rail;

a push bar, which is mounted to an opposite end of the two slidable core shafts;

a push bar seat, which is mounted to the push bar; and two CF-series bearings, which are mounted to the push bar seat and clamp the axle slide base therebetween to drive the axle slide base to slide along the axle when the servomotor rotates.

9. The servo-rotating all-function tool module according to claim 8, wherein the rotary shaft and the support bracket comprises a bearing arranged therebetween.

10. The servo-rotating all-function tool module according to claim 1, wherein the axle rotating tool module assembly comprises:

an axle slide base, which comprises a slide base hole corresponding to the axle and an opening corresponding to the support arm so as to be fit to the axle with the slide base hole to slide along the axle;

a CF-series bearing, which is mounted to a first end of the oscillating bar and is set in contact engagement with the seat body in a manner of being allowed to roll along the slope of the support arm;

the tool, which is mounted to a second end of the oscillating bar; and a spring, which is arranged between the second end of the oscillating bar and the axle slide base;

wherein a shaft hole is formed at a location between the first end and the second end of the oscillating bar for rotably mounting the oscillating bar in the opening of the axle slide base;

wherein when the servo transmission module assembly drives the axle slide base to slide along the axle, the CF-series bearing is driven to move along the slope to ascend/descend for controlling, in combination with a pulling force induced by the spring, a downward pressing operation or an upward returning operation of the tool.

11. The servo-rotating all-function tool module according to claim 10, wherein the axle slide base and the axle comprise a self-lubricating bearing arranged therebetween.

12. The servo-rotating all-function tool module according to claim 10, wherein a shaft pin that penetrates through the axle slide base receives a bearing fit thereto to rotatably support and mount the oscillating bar in the opening of the axle slide base.

13. The servo-rotating all-function tool module according to claim 10, wherein a spring peg and a screw respectively mounted to the axle slide base and the second end of the oscillating bar to support the spring between the second end of the oscillating bar and the axle slide base.

* * * * *